United States Patent [19]

Pagel

[11] Patent Number: 4,852,847

[45] Date of Patent: Aug. 1, 1989

[54] RELEASABLE MAILBOX MOUNTING APPARATUS

[76] Inventor: John R. Pagel, 14004 Pioneer Dr., Marathon, Wis. 54448

[21] Appl. No.: 84,611

[22] Filed: Aug. 11, 1987

[51] Int. Cl.[4] ..... B65D 91/00

[52] U.S. Cl. ..... 248/548; 248/145

[58] Field of Search ..... 248/548, 145, 418, 131, 248/202.1; 232/39; 403/2

[56] References Cited

U.S. PATENT DOCUMENTS

| | | | |
|---|---|---|---|
| 79,141 | 6/1868 | McFarlin | 248/548 X |
| 173,610 | 12/1916 | Ivey | 248/145 |
| 446,852 | 2/1891 | Davis | 248/548 X |
| 1,335,302 | 3/1920 | Stout | 248/548 X |
| 1,487,625 | 3/1924 | Tollefson . | |
| 1,616,432 | 2/1927 | Aarseth | 248/131 |
| 1,646,064 | 10/1927 | Obermeyer, Jr. . | |
| 2,216,408 | 10/1940 | Elmer | 248/145 |
| 2,552,915 | 5/1951 | Zachrich | 248/221 |
| 2,683,013 | 7/1954 | Amundson et al. | 248/145 |
| 2,738,941 | 3/1956 | Laurich et al. | 248/145 |
| 2,936,143 | 5/1960 | Anderson | 248/145 |
| 2,995,330 | 8/1961 | Alms | 248/145 |
| 3,011,598 | 12/1961 | Galloway et al. | 189/30 |
| 3,289,988 | 12/1966 | McKenney et al. | 248/145 |
| 3,395,544 | 8/1968 | Fisher, Sr. et al. | 248/548 X |
| 3,658,284 | 4/1972 | Haasl | 248/145 |
| 3,698,144 | 10/1972 | Stratton | 403/2 X |
| 3,796,170 | 3/1974 | Viera | 248/145 X |
| 4,130,239 | 12/1978 | Belsheim | 232/39 |
| 4,172,579 | 10/1979 | Steinman | 248/145 |
| 4,187,978 | 2/1980 | Dowker | 232/39 |
| 4,278,228 | 7/1981 | Rebentisch et al. | 248/548 |
| 4,395,012 | 7/1983 | Rance | 248/545 |

*Primary Examiner*—Ramon S. Britts
*Assistant Examiner*—Karen J. Chotkowski
*Attorney, Agent, or Firm*—Andrus, Sceales, Starke & Sawall

[57] ABSTRACT

A mailbox post mounting apparatus includes a post bracket and a mailbox bracket affixed respectively to the ground support post and the mailbox respectively. The brackets include abutting plate-like members having aligned openings with the mailbox in the mail receiving position. A break away pin is secured within the openings to lock the mailbox in place for receiving the mail. If the mailbox is struck by a vehicle, the pin releases or breaks away and releases the mailbox and its support from the post bracket and the post. In one unit, a post-bracket has a post securement plate with an integral lock plate extending outwardly and vertically, preferably upwardly. The mailbox bracket has a post securement plate having integral lock plate extending vertically at the same releasable angular orientation as the post plate. A releasable pin passes through aligned openings to lock the brackets to each other. In another unit, the post bracket and the mailbox bracket may be opposed and telescoped U-shaped channels having vertical pivot bolt units to establish a pivotal support. The overlapping channel sides include the pin openings receiving a cotter pin which releasably locks the mailbox in place. The mailbox bracket may include a threaded end member having a horizontal axis for receiving a corresponding threaded pipe to which the mailbox is mounted.

6 Claims, 2 Drawing Sheets

RELEASABLE MAILBOX MOUNTING APPARATUS

BACKGROUND OF THE PRESENT INVENTION

This invention relates to a releasable mail box mounting apparatus for mounting a roadside mailbox in place for mail delivery.

Mailboxes in rural, surburban and like locations are almost universally mounted at roadside locations. The mailbox is generally mounted to a vertical support, with a front door conveniently located for insertion of the mail from an automobile or other like vehicle. The support often includes a vertical support in the form of a wooden or metal post, with a horizontal support arm to which the mail box is secured.

Roadside mailboxes and the support structures are subject to damage and even destruction by passing vehicles moving, generally accidentally, into engagement therewith. The problem is particularly severe in northern climates having significant amounts of snowfall. Truck mounted snow plows are a particular source of damage, both from actual physical engagement by the wide snowblade and indirectly by the snow which is thrown against the box structure.

Various prior art suggestions exist for mounting of the mailbox on a movable support to avoid or limit the above damage to roadside boxes. A vertical pipe mounted swinging unit is shown in U.S. Pat. No. 4,130,239 which issued on Dec. 19, 1978. Many suggestions disclose spring loaded units which permit rotation of the mailbox unit, with the spring unit acting to return the box to the mail receiving position. U.S. Pat. No. 4,172,579 which issued Oct. 30, 1979 discloses a recent suggestion thereof. A releasable detent unit in a pivotally mounted mailbox support is shown in U.S. Pat. No. 1,790,123 which issued Jan. 27, 1931 wherein the spring-loaded detent unit holds the mailbox in the normal mail receiving position. Various other patents show pivotally mounted horizontal arms for supporting the mailbox in the roadside location.

| Patent No. | Issue Date | Inventor |
|---|---|---|
| 1,487,625 | 03-18-1924 | Tollefson |
| 1,646,064 | 10-18-1927 | Obermeyer, Jr. |
| 2,552,915 | 05-15-1951 | Zachrich |
| 2,683,013, | 07-06-1954 | Amundson |
| 2,738,941 | 03-20-1956 | Laurich |
| 2,936,143 | 05-10-1960 | Anderson |
| 2,995,330 | 08-08-1961 | Alms |
| 3,011,598 | 12-05-1961 | Galloway |
| 3,289,998 | 12-06-1966 | McKenney |
| 3,658,284 | 04-25-1972 | Haasl |
| 3,796,170 | 03-12-1974 | Viera |
| 4,130,239 | 12-19-1978 | Belsheim |
| 4,172,579 | 10-30-1979 | Steinman |
| 4,395,012 | 07-26-1983 | Rance |

Although the prior art include many suggestions, the apparatus is often quite complex and subject to failure and erratic operation in severe outdoor environment. Further, the complexity of the system result in rather costly apparatus which cannot be conveniently and inexpensively serviced and maintained. Thus, there is a continuing need for a simple, reliable but effective mailbox mounting apparatus for roadside mailboxes.

SUMMARY OF THE PRESENT INVENTION

The present invention is directed to a mailbox mounting apparatus which may be constructed with readily available structural plate elements, bolt-like members and associated pressure members and particularly to such mailbox mounting apparatus including a releasable and replaceable locking member. Generally, in accordance with the present invention, a ground-support post bracket and a mailbox bracket include abutting plate-like members or portions. The brackets are affixed to the ground support post and the mailbox respectively. The abutting plate-like members include aligned openings with the mailbox in the mail receiving position. A break away pin is secured within the openings to lock the mailbox in place. If the supported mailbox unit is struck, the pin releases or breaks away and releases the mailbox and its support from the post bracket and the post, thereby avoiding or significantly minimizing damage to the mailbox assembly.

In a particularly reliable and inexpensive mounting apparatus, each bracket assembly includes a post-bracket having securement means to secure the post-bracket to a post with an integral lock plate extending outwardly and vertically, preferably upwardly, from such means in combination with a separate mailbox bracket having securement means to secure to the mailbox and an integral lock plate extending over and vertically of the means at the same angular orientation as the post plate and located in abutting engagement. The lock plates have aligned openings and are coupled to each other by a pin such as a cotter pin passing through the openings and serving to lock the brackets to each other.

In an alternate embodiment, the post bracket and the mailbox bracket includes opposed U-shaped channels. In the assembled relation, the channels are telescoped with abutting upper and lower sides. A pivot bold unit passes through the channel sides to establish a pivotal support. The pivot bolt unit may include a pressure or lock washer to control the holding of the mailbox in operative position. The overlapping channel sides include aligned openings, and a pin, such as a simple cotter pin within the openings locks the mailbox in place for receiving the mail. Again, force is created by a moving vehicle or the like will force the mailbox and support to move, with the break-away of the cotter pin, and allow the mailbox to move out of the path of the vehicle. In this embodiment, the brackets may take the form of simple stacked plate members having means for securement to the post and mailbox, with aligned openings in the plates for receiving a cotter pin. The mailbox bracket may include a threaded end member having a horizontal axis for receiving a corresponding threaded pipe to which the mailbox is mounted.

The present invention thus provides a simple mailbox mounting apparatus which is readily constructed with simple structural plate and a readily available break-away locking means, and where a pressurized controlled pivotal movement of the mailbox is desired upon break-away, a simple lock washer means is introduced into pivot bolt assembly.

BRIEF DESCRIPTION OF THE DRAWINGS

The drawings furnished herewith illustrate the best mode presently contemplated in carrying out the invention.

In the drawings.

DESCRIPTION OF THE ILLUSTRATED EMBODIMENT

Figure 1:
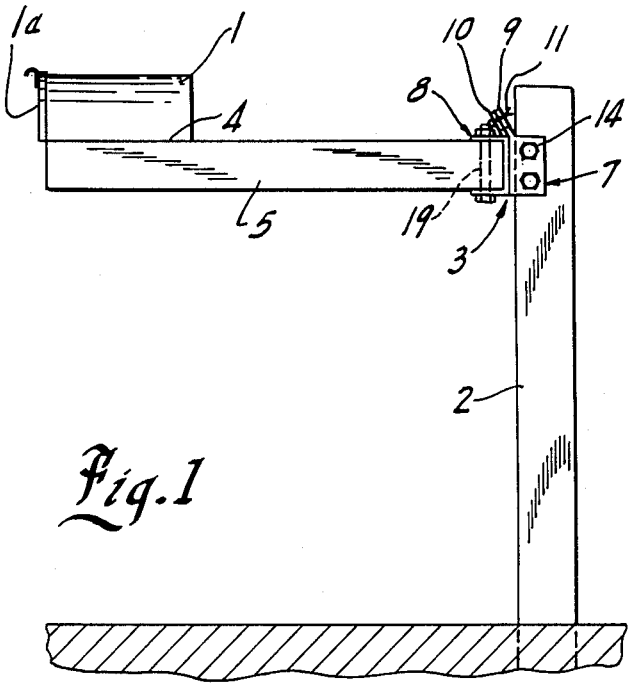
FIG. 1 is a side elevational view of mailbox mounted to a roadside stand in accordance with one embodiment of the invention.

Referring to the drawing and particularly to FIG. 1, a typical rural mailbox 1 is shown mounted to a vertical ground-support post 2 by a break-away mounting unit 3 constructed in accordance with one embodiment of the present invention. The mailbox 1 is a typical tubular construction having a fixed rear or back wall and a pivotal front wall or door 1*a*. A flat bottom wall 4 is secured to a horizontal arm 5 to locate the box in spaced relation to the ground support post 2. In FIG. 1, the ground support post 2 and the horizontal support arm 5 are simple wooden post members having a square cross-section and to which the mounting unit 3 is readily secured. The support members 2 and 5 may of course be of any other construction or material, such as a round log, pipe or the like. The present invention is particularly directed to the coupling unit 3 and the mailbox and support members are therefore only described in relation to the particular illustrated embodiment of the invention.

Figure 2:
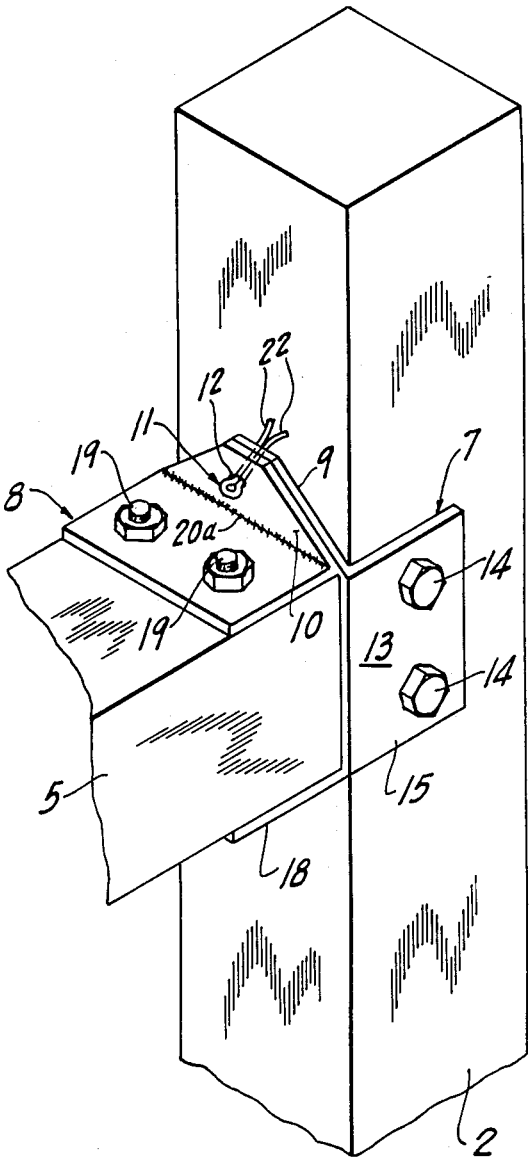
FIG. 2 is a pictorial view of the mounting unit shown in FIG. 1.
Figure 3:
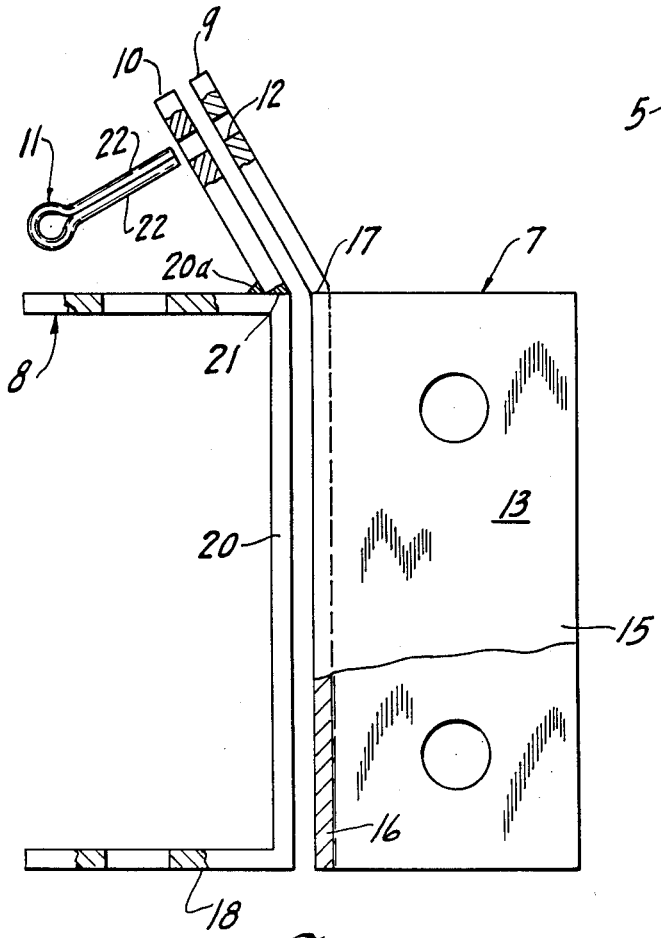
FIG. 3 is a view of the two-piece mounting bracket unit shown in FIGS. 1 and 2.
Figure 6:
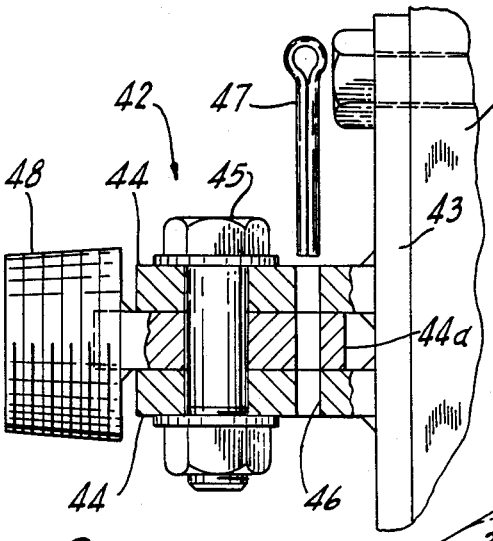
FIG. 6 is side elevational view of FIG. 5, with parts broken away to illustrate certain detail of construction.

Referring particularly to FIGS. 1–3, the coupling unit 3 includes a post bracket 7 secured to post 2 and a mailbox bracket 8 secured to the horizontal arm 5. The brackets 7 and 8 include abutting lock plates 9 and 10 which extend outwardly into an exposed position. A break-away lock element 11 passes through aligned openings 12 in plates 9 and 10 to lock the brackets 7 and 8 to each and support the mailbox in the operative position.

If the mailbox 1 and the support arm 5 are struck from the side, the force acts to twist the arm assembly including the mailbox bracket 8 about the post bracket 7 and post 2. The pin unit 11 readily breaks or moves from the opening 12 to allow the separation and movement of the mount assembly without damage to the assembly.

The separation is readily visually apparent, and the owner can easily remount the arm assembly and lock the assembly in place with a new cotter pin 11.

More particularly, in the illustrated embodiment of FIGS. 2 and 3, the post bracket 7 including a U-shaped channel 13 formed of flat plate and complementing the square post 2. The channel 13 is telescoped over the post 2 and is conveniently affixed thereto by through bolts 14 passing through the side plates 15 and post 2. The channel 13 includes a base 16 abutting the post 2. The bracket 7 is located substantially at the desired height of mailbox 2.

The special lock plate 9 is shown formed as an integral extension from the top edge 17 of the base plate 16. Lock plate 9 extends upwardly and outwardly from base plate 16. The angular orientation of the lock plate 9 is not critical but is preferably selected to an intermediate location between the post 2 and arm 5.

The mailbox arm bracket 8 is similarly formed with a U-shaped channel 18 which telescopes over the outer end of arm 5. Suitable bolt units 19 are shown securing the bracket to arm 5 with the base 20 abutting the end of the arm and also the base 16 of the post channel 13.

The arm lock plate 10 is integrally formed with, or otherwise fixed as by a weld 20*a*, the top edge 21 of the base plate 20. The lock plate 10 extends vertically and inwardly over the channel 18 of bracket 8. The angular orientation of lock plate 10 is the same as that of the lock plate 9 on the post bracket. The bracket 8 is mounted with its base plate abutting the base plate of the post bracket 7 and with the locking plates 9 and 10 in corresponding abuttment and the locking openings 12 aligned. Cotter pin 11 passes through the openings and the two sides or legs 22 are spread, as shown in FIG. 2, to securely lock the plates of such abuttment and thereby secure the location. The total weight of the mailbox and the arm support forces the base plate 20 of the arm assembly into firm engagement with the base plate 16 of the post bracket 7 such that the cotter pin 11 readily support the assembly in place, for functioning as previously set forth. In this embodiment, the mailbox assembly would separate completely in moving from the path of the vehicle. The structure however provides a significantly simple but reliable support which is low in initial cost as well as subsequent servicing and maintenance. The apparatus however is readily constructed with pivot mechanism to maintain a unitary assembly with the mailbox moved from the path of the vehicle, such for example as shown in FIG. 4.

Figure 4:
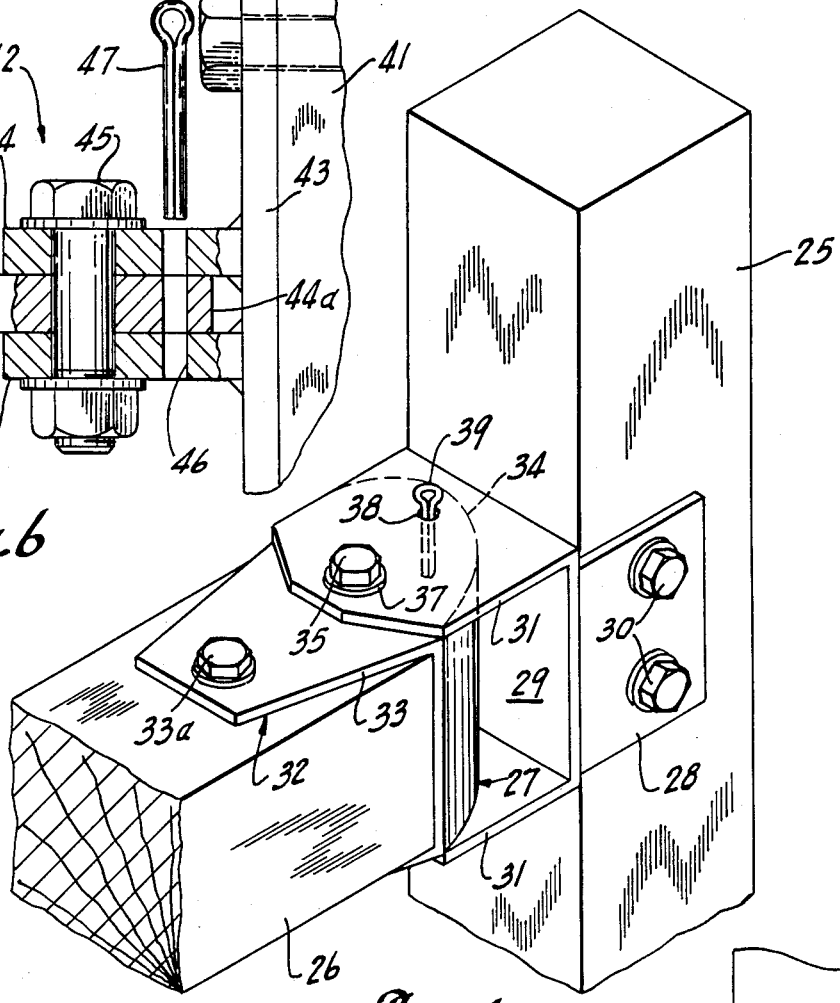
FIG. 4 is a similar to FIG. 1 illustrating another embodiment of the invention.

Referring to FIG. 4, a ground support post 25 and arm 26 similar to that of FIGS. 1 and 2 are particularly shown with a swivel coupling unit 27 constructed to illustrate another embodiment of the invention.

The coupling unit 27 includes a post bracket 28 having a base plate 29 abutting post 25, with a through bolt unit 30 securing the bracket 28 to the post. The bracket 28 is U-shaped with vertically spaced plates 31 extending outwardly from plate 29. The plates 31 are spaced slightly in excess of the depth of the arm 26.

An arm bracket 32 has a U-shaped portion 33 telescoped over the end of arm 26 and secured thereto as by bolt unit 33*a*.

Pivot plates 34 project outwardly from bracket 32 and are spaced to telescope within the post plates 31, and generally in close sliding engagement therewith. A pivot bolt and nut unit 35 extend vertically through appropriately aligned openings in the plates 31 and 34 and pivotally mount the mailbox assembly, with appropriate flat washers 36 at the opposite ends. A pressure or lock washer 37 is shown located at the upper end to firmly but releasably lock the pivot assembly together.

In addition, the upper plates 31 and 34 of the brackets have aligned openings 38. A cotter pin 39 is secured within the openings 38 to lock the pivot assembly in place under all use. However, upon engagement by a moving force such as a snowplow blade, the arm assembly is allowed to pivot with the cotter pin 39 collapsing or breaking without damage to the bracket plates. Again, the apparatus is readily constructed from available structural plates and channels as wells as bolt and nut assemblies, break-away pins, cotter pins and the like.

The above embodiments include channel members for mounting to wood posts and arms. The invention may also be adapted to pipe-mounted support apparatus.

Figure 5:
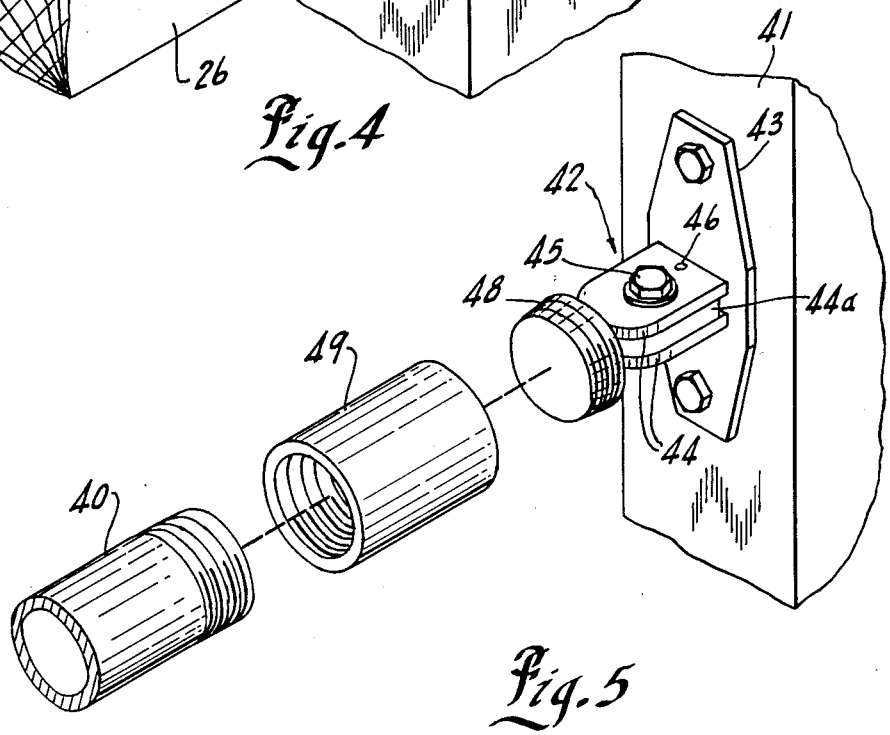
FIG. 5 is a pictorial view of a pipe support unit for supporting of the mailbox.

A pipe arm apparatus is, for example, shown in FIG. 5, wherein the mailbox arm is shown as a length of standard pipe 40 connected to a vertical post 41 by a coupling 42. A coupling includes a flat plate 43 secured to the face of post 41, which is shown as wooden post but may also be a round or square pipe, a flat plate-like member or the like. A pair of flat plates 44 are secured to plate 43 and spaced generally in accordance with the thickness of an arm plate 44*a*. The arm plate 44*a* is located between plates 43 and extends slightly outwardly. A nut and bolt unit 45 passes through aligned openings to pivotally couple plate 44*a* to the plate 44. Aligned locking openings 46 are located inwardly of unit 45 and a cotter pin 47 extends therethrough to releasably lock the plates against rotation.

In FIG. 5, a coupling pipe member 48 having a standard external pipe thread is welded or otherwise integrally connected to the plate 44*a*. The arm pipe 40 is coupled to the member 48 by a simple threaded coupler 49.

The unit of FIG. 5 functions as the previous embodiments, with the cotter pin 47 firmly and securely locking the assembly in the normal mail receiving position, and releasing the assembly for movement of the mailbox and arm assembly from the path of an engaging vehicle or the like.

The unit of FIG. 5 is again formed of readily available structural elements which can be readily produced at minimum cost.

The present invention, particularly as disclosed in the above embodiments is adapted to mass productin, as well as to production on smaller scale by a small machine shop or the like.

Various modes of carrying out the invention are contemplated as being within the scope of the following claims particularly pointing out and distinctly claiming the subject matter which is regarded as the invention.

I claim:

1. A mailbox mounting apparatus for roadside mounting of a mailbox adjacent the side of the path of over-the-road vehicles, comprising a mailbox bracket having a support means including a horizontal support member extending outwardly of said bracket and having an outer end portion, a mailbox mounted to the outer end portion of said horizontal support member and having an outer access opening, a vertical post bracket for attachment to the upper end of a vertical ground support for supporting a mailbox in spaced relation to the ground with the access opening accessible from a mail delivery automobile, first and second overlapping rigid members secured one to each of said brackets and located for horizontal movement, said overlapping rigid members having aligned locking openings in the mail receiving positions, and a break-away pin means passing through said openings to releasably secure said brackets in said mail receiving position, said break-away pin releasing from said openings in response to a vehicle engaging and moving past said mailbox, wherein said overlapping rigid members include a first horizontal mounting plate including one of said locking openings and a mailbox supporting connector secured to the edge of said mounting plate, a releasable means connecting said horizontal support member to said connector, and said post bracket including a vertical plate means for mounting the bracket to the vertical post, said overlapping rigid members including a second horizontal mounting plate including one of said locking openings, a bolt means connecting said horizontal plates for relative movement and with said locking openings aligned to receive the pin means.

2. A mailbox mounting apparatus for roadside mounting of a mailbox adjacent the side of the path of over-the-road vehicles, comprising a mailbox bracket having a support means including a horizontal support member extending outwardly of said bracket and having an outer end portion, a mailbox mounted to the outer end portion of said horizontal support member and having an outer access opening, a vertical post bracket for attachment to the upper end of a vertical ground support for supporting a mailbox in spaced relation to the ground with the access opening accessible from a mail delivery automobile, first and second overlapping rigid members secured one to each of said brackets and located for horizontal movement, said overlapping rigid members having aligned locking openings in the mail receiving positions, and a break-away pin means passing through said openings to releasably secure said brackets in said mail receiving position, said break-away pin releasing from said openings in response to a vehicle engaging and moving past said mailbox, wherein said rigid member on said mailbox bracket includes a vertically extended inclined plate projecting from said support means and adjacent said mounting plate, said rigid member on said post bracket including a vertical inclined plate abutting said first name inclined plate, and said inclined plates including said aligned locking openings and said break-away pin means.

3. A mailbox mounting apparatus for roadside mounting of a mailbox adjacent the side of the path of over-the-road vehicles, comprising an integral U-shaped mailbox bracket including a pair of horizontal support plates projecting outwardly of a base member, a mailbox support adapted to project between said support plates and projecting outwardly therefrom and having an outer end for support of a mailbox in spaced relation to said bracket, a post mounting bracket for attachment to the upper end of a vertical support post and including a mounting member for attachment to the post, said brackets including overlapping locking members having aligned openings, and a break-away pin means passing through said openings to releasably secure said brackets in said mail receiving position, said break-away pin releasing from said openings in response to a vehicle engaging and moving past said mailbox.

4. The apparatus of claim 3 wherein said overlapping locking members of said post mounting bracket includes a U-shaped member having a pair of spaced horizontal arms spaced to correspond to the spacing of said horizontal support plates and telescoped over the end of the support plates adjacent to said base member, a vertical pivot rod unit extended through said overlapping plates and arms to pivotally support said mailbox bracket for pivoting in a horizontal direction, and said aligned openings and break-away pin located in said overlapping plates and arms in spaced relation to said pivot rod unit.

5. The apparatus of claim 4 wherein said base member is generally U-shaped in cross section and said arms of said post bracket are plate member projecting over said U-shaped base members and plates of said post bracket.

6. The apparatus of claim 5 wherein said pivot rod unit is located within an outer portion of the arms and said openings and break-away pin means are located between the pivot rod unit and said base member.

* * * * *